US007505021B2

(12) United States Patent
Fujikura

(10) Patent No.: US 7,505,021 B2
(45) Date of Patent: Mar. 17, 2009

(54) CAPACITIVE LOAD DRIVING CIRCUIT AND DISPLAY PANEL DRIVING CIRCUIT

(75) Inventor: Katsuyuki Fujikura, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 679 days.

(21) Appl. No.: 11/024,300

(22) Filed: Dec. 29, 2004

(65) Prior Publication Data

US 2005/0156864 A1 Jul. 21, 2005

(30) Foreign Application Priority Data

Jan. 6, 2004 (JP) ..... 2004-001426

(51) Int. Cl.
*G09G 3/36* (2006.01)

(52) U.S. Cl. ..... 345/100; 345/98

(58) Field of Classification Search ..... 345/52, 345/98, 94, 96, 100, 103
See application file for complete search history.

(56) References Cited

U.S. PATENT DOCUMENTS

| | | | | |
|---|---|---|---|---|
| 5,892,493 | A * | 4/1999 | Enami et al. | 345/94 |
| 6,359,608 | B1 * | 3/2002 | Lebrun et al. | 345/100 |
| 6,731,266 | B1 * | 5/2004 | Jung | 345/103 |
| 7,215,311 | B2 * | 5/2007 | Kim | 345/98 |
| 2003/0090452 | A1 * | 5/2003 | Uchino et al. | 345/96 |
| 2003/0151564 | A1 * | 8/2003 | Yamashita et al. | 345/52 |

FOREIGN PATENT DOCUMENTS

| | | |
|---|---|---|
| CN | 1589461 | 3/2005 |
| JP | 4-52684 | 2/1992 |
| JP | 11-133462 | 5/1999 |
| JP | 2002-149125 | 5/2002 |
| KR | 96-008100 | 6/1996 |
| KR | 2002-59222 | 7/2002 |

OTHER PUBLICATIONS

Korean Office Action dated Mar. 21, 2007 with partial English translation.
Chinese Office Action dated Apr. 13, 2007 with English tranlation.

* cited by examiner

*Primary Examiner*—Amare Mengistu
*Assistant Examiner*—Yuk Chow
(74) *Attorney, Agent, or Firm*—McGinn IP Law Group, PLLC

(57) ABSTRACT

A display panel driving circuit includes gate lines, data lines, a first selector, a second selector, liquid crystal cells and a drive section. The gate lines extend to a first direction. The data lines extend to a second direction. The first selector selects a selection gate line from the gate lines. The second selector selects a selection data line from the data lines. The liquid crystal cells are placed in positions corresponding to crossover points between the gate lines and the data lines. The drive section outputs drive signals which drive the liquid crystal cells through the second selector based on inputted picture signals. The second selector includes main switch sections and a switch control section. The switch control section controls switching on and off of the main switch sections. Each of main switch sections includes switch elements in series. The each of main switch sections is connected with associated one of data lines at one electrode. The each of main switch sections is connected with an output electrode of the drive section and others of main switch sections at another electrode.

25 Claims, 11 Drawing Sheets

CAPACITIVE LOAD DRIVING CIRCUIT AND DISPLAY PANEL DRIVING CIRCUIT

BACKGROUND OF THE INVENTION

1. Field of the Invention

The present invention relates to a capacitive load driving circuit and a display panel driving circuit. More particularly, the present invention relates to the capacitive load driving circuit and the display panel driving circuit which can improve a display performance.

2. Description of the Related Art

A flat-panel display has been widely known, which can be able to downsize its thickness and weight. The flat-panel display is an indispensable display apparatus for our modern life. Especially, a liquid crystal display (LCD) has been greatly improved in a picture quality, a high resolution and cost-performance because of a result of competitive efforts by enterprises. Generally, the liquid crystal display apparatus is mainly composed of a liquid crystal display panel and a driver IC. It is highly desired to increase the number of display pixels in recent years. Therefore, it is necessary to increase the number of outputs for the driver IC. Responding to this, the downsizing of the chip may be achieved by refining the driver IC design rule. However, a simply downsizing of the chip causes the connection pitch between the driver IC and the display panel to be narrow. This may possibly lead to decrease of the manufacturing yield. Additionally, because drive voltage depends on the property of the liquid crystalline in the display panel, it is hard to lower the voltage considerably to a large degree. Therefore, it is difficult for the output circuit having a large area in the driver IC to adopt the refined design rule as a low-voltage circuit. This means that the downsizing of the chip in the driver IC is impossible and the cost for the driver IC in entire liquid crystal display can not be lowered. This is why the another approach is necessary for the downsizing of the chip.

Japanese Laid Open Patent Application (JP-A-Heisei 4-52684 discloses a technique of a driving method of the Liquid crystal panel to reduce the chip size of the driver IC. In the conventional method, source lines are extended to the Y direction in the liquid crystal panel of an active matrix type. The source lines are arranged in the X direction to be driven by a driver IC. The driver IC has a plurality of data lines, and each of first switching elements is provided in each of the data lines. In addition, each of second switching elements is provided in each source line of the above-mentioned liquid crystal display panel. The outputs of the above-mentioned driver IC connect the plurality of the source lines, which correspond to the data lines, of the liquid crystal display panel. Then, each of the first switching elements of the driver IC is sequentially switched on and off synchronizing with each of the second switching elements of the liquid crystal display panel. Then, the source data from the data line is time-shared to be supplied to the source line corresponding to the above-mentioned data line from the one output of the driver IC. Such configuration of the circuit in the liquid crystal display panel contributes to reduce the circuit scale of the driver IC.

FIG. 1 is a circuit diagram showing a configuration of a driving circuit of the conventional display panel in which the technique in JP-A-Heisei 4-52684 is applied. A driving circuit of the display panel includes a liquid crystal display panel 104 and a driver IC 101. A plurality of data lines 121 and a plurality of gate lines 122 are formed on the liquid crystal display panel 104. Pixels 110 are connected to parts of rectangular grids by these lines. The pixel 110 includes a pixel switch 112 and a liquid crystal cell 111. Six data lines D1 to D6 configure a data line array. One end of each switch element connects with a drive-side end of each data line. The other ends of the switches are commonly connected with each other and connected with an output circuit 102 of the driver IC 101.

The driver IC 101 includes at least a data register 107, a latch 106, and an output circuit 102. The data register 107 sequentially stores digital picture signals of n bits inputted from an outside. When the data register 107 stores digital picture signals for one gate line, then transmits those signals to the latch 106. The latch 106 outputs the stored digital picture signals to the output circuit 102 sequentially. For instance, digital picture signals R1, G1, B1, R2, G2, and B2 of n bits from an outside are stored in the data register 107 sequentially. These signals are transmitted to the latch 106 at the same time. Then, the picture signals R1 G1, B1, R2, G2, and B2 stored in latch 106 are outputted in this order. The output circuit 102 converts the input digital picture signal into analog picture signals, and drives data lines D1 to D6. At this time, the switching elements are selected and turned on in order of 191, 192, 193, 194, 195 and 196 synchronizing with the output timing of the latch 106. The picture signal R1, G1, B1, R2, G2, and B2 are written in the data lines D1 to D6 respectively. The adjoining data line array is also driven in parallel in the similar timing.

The liquid crystal display panel 104 and the pixel 110 are considered as a capacitive load in the light of the driver IC 101. Therefore, the electric charge of the picture signal (hereinafter referred to as the picture signal charge) is stored in each data line by the above-mentioned serial operation. Due to a scanning selection of gate lines 121, the pixel transistor 112 becomes ON state and the picture signal charge is transmitted to the liquid crystal cell 111 respectively, then pixel transistor 112 becomes OFF state after all writing operation in the data lines is completed. As a result, the writing operation of the picture signal in the liquid crystal cell 111 for one gate line is completed.

Due to the above-mentioned configuration, the output circuit 102 can be shared in six data lines. Therefore, it is possible to reduce the scale of the output circuit to one-sixth (1/6) of a usual configuration in this example. As a result, it can be possible to downsize the chip of the driver IC. Moreover, the circuit scale can be reduced by increasing the number of the sharing data lines.

In the above conventional technique, brightness unevenness in a vertical direction (hereinafter referred to as a vertical unevenness) might be highly visible in a single-color halftone display and a two-color halftone display. Here, the single-color halftone display means the display in which brightness of only one of RGB three primary colors composed of a pixel is a halftone. The two-color halftone display means the display in which brightness of two of RGB three primary colors is a halftone. The vertical unevenness indicates an unevenness of dark and light in brightness appearing in the direction parallel to the gate line.

Unevenness in the display such as the vertical unevenness occurs by a change of the picture signal voltage maintained in the data line 121 when the picture signal is the written to the liquid crystal cell 111. One of the reasons of this voltage change is that the writing electric charge in the data line 121 is released toward the driver IC 101 due to the leakage current of the switching elements 191 to 196. It should be noted that the switching elements 191 to 196 are transistors in general. The leakage current of the transistor tends to become higher as the voltage between drain and sources becomes higher.

FIG. 2 is a graph showing a general relation between a brightness and applied voltage of the liquid crystal display cell (in a normally white mode). A vertical axis is brightness L. The brightness L=1 is white, and L=0 is a black. A horizontal axis is a voltage V applied to the liquid crystal cell 111. It is assumed that the voltage change of the picture signal written in the data line 121 should be stable. The change ratio (ΔL2/ΔV2) of the brightness in the halftone of the gradation is larger than the change rate (ΔL1/ΔV1, ΔL3/ΔV3) of the brightness in other gradation. Therefore, when the voltage of the picture signal in the halftone of the gradation is applied, the change of the picture signal voltage leads to remarkable enlargement of the change of brightness. Therefore, the unevenness in the display becomes highly visible.

FIG. 3 is graphs showing the change of the brightness of the driving circuit in the conventional display panel. FIG. 3(*a*) shows the drive voltages (the picture signal voltages) and their voltage changes. Here, the drive voltages (the picture signal voltages) are respectively applied to the data lines D1 to D6 by the six time-sharing drive. The voltage changes is the changes of voltage in the data lines when the data lines are in the non-selection state and maintain the written picture signal voltage after the driving. A vertical axis indicates elapsed time, and a horizontal axis indicates the picture signal voltage (the applied voltage). A line chart is described for each data line D1 to D6. FIG. 3(*b*) shows the relation between the brightness and the applied voltage of the liquid crystal cell. A vertical axis indicates the brightness L and a horizontal axis indicates the voltage of the picture signal (the applied voltage). FIG. 3(*c*) shows the change of the brightness of the liquid crystal cell according to the voltage change of the maintained picture signal voltage (the applied voltage) in each data line. A vertical axis indicates the brightness L and a horizontal axis indicates the data line. The liquid crystal cell in this example is operated in normally white mode.

Here, a following operation shown in FIG. 3(*a*) is assumed as an example. That is, at t=t0, a picture signal R1 having the applied voltage V2 of the highest gradation is written in the data line D1. At t=t1, a picture signal G1 having the applied voltage V1 of halftone is written in the data line D2. At t=t2, a picture signal B1 having the applied voltage V2 of the highest gradation is written in the data line D3. Then, at t=t3 to t5, the same signal pattern of the data lines D1 to D3 are repeated to the data lines D4 to D6 for wiring of the picture signals.

As shown in FIG. 3(*a*), in a data line D2 selection term (that is, "D2": t=t1 to t2), the voltage V2 (the applied voltage) written in the data line D1 becomes in a maintenance state. However, the voltage of the data line D1 is changed by a leakage current of a switching element 191, being gradually pulled to the voltage V1 that is the writing voltage of the data line D1. In a data line D3 selection term (that is "D3": t=t2 to t3), the voltage of the data line D2 is changed by a leakage current of a switching element 192, being gradually pulled to the voltage V2 that is the writing voltage to the data line D3. At this time, the voltage of the data line D1 tries to return the voltage V2 that is an original writing voltage. However, the voltage between the drain and source of the switching element 191 is smaller than that at the data line D2 selection term. Therefore, the voltage of the data line D1 does not return to the voltage V2 enough. Thus, the difference is larger between the writing voltage of the following data line selection term (the applied voltage) and the maintenance voltages that has already been written, the more the voltage change in the data line grows. Moreover, the voltage change becomes larger according to the enlargement of the maintenance time. Here, the maintenance time is the time period after writing in the data line to turning off the pixel transistor 112. Therefore, the change of brightness becomes large according to the enlargement.

In this way, in the six time-sharing drive of the conventional technique, for instance, in the case that the picture signal with halftone at the same level V1 in the lines D2 and D5, the voltage change in the data line D2 becomes larger than that in the data line D5. Therefore, the brightness of the liquid crystal cell by the data line D2 is different from that by the data line D5. Especially, in the case of the halftone, as shown in FIGS. 3(*a*) and 3(*b*), the brightness is greatly different even if the voltage change is slight. Then, as shown in FIGS. 3(*b*) and 3(*c*), the brightness changes ΔLD2 larger than the original brightness in the case of the liquid crystal cell of the data line D2. Also, the brightness changes ΔLD5 larger (ΔLD2>ΔLD5) than the original brightness in the case of the liquid crystal cell of the data line D5.

Generally, RGB pixels are arranged in the shape of stripe in a color liquid crystal display panel. In this case, the data lines D2 and D5 execute the displaying of G color. At this time, in the case of displaying a picture by the combination of the white level and the halftone level as shown in FIG. 3, the color is changed in each adjoining RGB pixels. It is obvious that these changes never occur in the display by the same picture signal voltage in three colors of RGB. The above-mentioned change of the maintenance voltage becomes more remarkable as the number of the time-sharing drive increases in order to downsizing of the chip in the driver IC. Because the difference of the maintenance times after the writing in the same data line array becomes large. Thus, if the brightness unevenness is seen between the data lines, it is recognized as the vertical unevenness as an entire display. As a result, the picture quality may acutely decreases.

The technique is desired, which reduces factors of the decrease of the picture quality and achieves a high-resolution picture. Also, the technique is desired, which reduces the brightness unevenness such as the vertical unevenness. Also, the technique is desired, which reduces the brightness unevenness between the data lines. Also, the technique is desired, which maintains the voltage of the picture signal in the data lines stably. Also, the technique is desired, which restricts the leakage current in the data lines.

In conjunction with the above-mentioned technique, Japanese Laid Open Patent Application (JP-A 2002-149125) discloses a data line driving circuit of the panel display. The data line driving circuit of this panel display includes a selection means, an analog buffer, a distribution means, a pre-charge means, and a control means. The selection means receives a plurality of voltages that corresponds respectively to each of a plurality of data lines in lots of data lines of the panel display. The analog buffer is commonly provided to a plurality of the data lines that receive the voltage that is selected by the selection means selectively to output. The distribution means receives the output from the analog buffer to distribute it to the one of the plurality of data lines selectively. The pre-charge means is provided to each of the lots of the data lines respectively. And the pre-charge means executes a pre-charge of the corresponding data line on any one of high drive voltage or low drive voltage according to the at least the first bit signal of the digital data corresponding to the corresponding data line. The control means controls the selection means, the distribution means and the pre-charge means. A scanning line selection term includes a pre-charge term and a plurality of writing term following. Then, in each scanning lines selection term, the control means controls the distribution means so as to separate an output of the analog buffer from all of the plurality of data line in the pre-charge term. The control means operates all the pre-charge means to pre-charge all the plurality of data lines. In the plurality of writing terms, the control means lets all of the pre-charge means a non-operation state. The control means operates the selection means and the distribution means such that the voltage corresponding to the first data line in the plurality of data lines is supplied to the analog buffer and the output of the analog buffer is supplied to the first data line in a first writing term within the plurality of writing terms. Also, in the second writing term within the plurality of writing terms, the voltage corresponding to the second data line in the plurality of data lines is supplied to the analog buffer, and the output of the analog buffer is supplied to the second data line.

In conjunction with the above-mentioned technique, Japanese Laid Open Patent Application (JP-A-Heisei 11-133462) discloses a liquid crystal device and an electronic device. In the liquid crystal device, a liquid crystal is held being sandwiched by a couple of substrates. One substrate of the couple of substrates includes a pixel electrode, a seal material, and a shading member. The pixel electrodes is formed in matrix. The seal material surround the liquid crystal sandwiching the couple of substrates in surroundings of the screen region, which is defined by the plurality of pixel electrodes on the one substrate. The shading member is formed on the another substrate of the couple of substrates along an outline of the display region between the seal material and the display region. The peripheral circuit is formed of a thin film transistor. The driver circuit is arranged on the one substrate in the counter position of the shading member which is formed on the another substrate.

SUMMARY OF THE INVENTION

Therefore, an object of the present invention is to provide a capacitive load driving circuit and a display panel driving circuit which reduce factors of the decrease of the picture quality to achieve a high-resolution picture, in a single-color halftone display and a two-color halftone display.

Another object of the present invention is to provide a capacitive load driving circuit and a display panel driving circuit which reduces the brightness unevenness such as the vertical unevenness and the brightness unevenness among the data lines, in a single-color halftone display and a two-color halftone display.

Still another object of the present invention is to provide a capacitive load driving circuit and a display panel driving circuit which maintains the voltage of the picture signal in the data line stably, in a single-color halftone display and a two-color halftone display.

Yet still another object of the present invention is to provide a capacitive load driving circuit and a display panel driving circuit which restricts the leakage current in the data lines, in a single-color halftone display and a two-color halftone display.

This and other objects, features and advantages of the present invention will be readily ascertained by referring to the following description and drawings.

In order to achieve an aspect of the present invention, the present invention provides a display panel driving circuit including: a plurality of gate lines, a plurality of data lines, a first selector, a second selector, a plurality of liquid crystal cells and a drive section. The plurality of gate lines is configured to extend to a first direction. The plurality of data lines is configured to extend to a second direction different form the first direction. The first selector is configured to select a selection gate line from the plurality of gate lines. The second selector is configured to select a selection data line from the plurality of data lines. The plurality of liquid crystal cells is configured to be placed in positions corresponding to crossover points between the plurality of gate lines and the plurality of data lines. The drive section is configured to output drive signals which drive the plurality of liquid crystal cells through the second selector based on inputted picture signals. Each of the plurality of liquid crystal cells includes a transistor and a capacitive element. The transistor is configured to be connected with associated one of the plurality of gate lines at a gate electrode, and associated one of the plurality of data lines at one of other two electrodes. The capacitive element is configured to be connected with the transistor at another of other two electrodes. The second selector includes a plurality of main switch sections and a switch control section. The switch control section is configured to control switching on and off of the plurality of main switch sections. Each of the plurality of main switch sections includes a plurality of switch elements in series. The each of the plurality of main switch sections is connected with associated one of the plurality of data lines at one electrode. The each of main switch sections is connected with an output electrode of the drive section and others of the plurality of main switch sections at another electrode.

In the display panel driving circuit, the each of the plurality of main switch sections may be configured to include a first switch element and a second switch element connected with each other in series as the plurality of switch elements. The second switch element may be connected with associated one of the plurality of data lines at one electrode as a fourth electrode. The second switch element may be connected with the first switch at another electrode as a third electrode. The first switch element may be connected with the second switch element at one electrode as a second electrode. The first switch element may be connected with the output electrode of the drive section at another electrode as a first electrode.

In the display panel driving circuit, the first selector may select the selection gate line. The switch control section may select the selection data line by switching on a selected one, as a selection main switch section, of the plurality of main switch sections. The drive section may output the drive signal through the selection main switch and the selection data line to selection liquid crystal cell selected by the selection gate line and the selection data line from the plurality of liquid crystal cells.

In the display panel driving circuit, the each of the plurality of main switch sections may be configured to further include a capacitive element connected with at least one of plurality of wiring which connects adjacent ones of the plurality of switch elements.

In the display panel driving circuit, the first selector may select the selection gate line. The switch control section may select the selection data line by switching on a selected one, as a selection main switch section, of the plurality of main switch sections. The drive section may output the drive signal through the selection main switch and the selection data line to selection liquid crystal cell selected by the selection gate line and the selection data line from the plurality of liquid crystal cells. The switch control section may switch off predetermined one of the plurality of switch elements of the selection main switch section. The predetermined one may be placed in the side of the drive section from a position where the capacitive element is connected. And then the switch control section may switch off others of the plurality of switch elements of the selection main switch section.

In the display panel driving circuit, the second selector may be configured to further include a plurality of sub-switch sections as a switch. A plurality of wiring may connect adjacent ones of plurality of switch elements of each of the plurality of main switch sections. Each of the plurality of sub-switch sections may be connected with at least one of the plurality of wiring of corresponding one of the plurality of main switch sections at one electrode, and a power source at another electrode.

In the display panel driving circuit, the switch control section may switch on ones of the plurality of sub-switch sections in order to apply a predetermined voltage by the power source to associated one of the plurality of wiring. The ones of the plurality of sub-switch sections are associated with ones, which is switched off, of the plurality of main switch sections.

In the display panel driving circuit, the first selector may select the selection gate line. The switch control section may select the selection data line by switching on a selected one, as a selection main switch section, of the plurality of main switch sections, and may switch off one, which is associated with the selection main switch section, of the plurality of sub-switch section. The drive section may output the drive signal through the selection main switch and the selection data line to selection liquid crystal cell selected by the selection gate line and the selection data line from the plurality of liquid crystal cells.

In the display panel driving circuit, a voltage which the power source applying to the plurality of wiring may be approximately a half of a maximum voltage of the drive signals.

In the display panel driving circuit, a voltage which the power source applying to the plurality of wiring may be around a voltage in which a ratio of a change of transmittance to a change of an applied voltage to each of the plurality of liquid crystal cells is maximum.

In the display panel driving circuit, each of the plurality of switch elements may include a thin film transistor. The thin film transistor may be formed on a substrate where the plurality of liquid crystal cells are formed.

In order to achieve another aspect of the present invention, the present invention provides a capacitive load driving circuit including: a plurality of capacitive loads, a plurality of main switch sections, a drive section and a switch control section. The drive section is configured to output drive signals which drive the plurality of capacitive loads, based on inputted signals which control the plurality of capacitive loads. The switch control section is configured to control switching on and off of the plurality of main switch sections. Each of the plurality of main switch sections includes a plurality of switch elements in series. The each of main switch sections is provided with associated one of the plurality of capacitive loads. The each of main switch sections is connected with the associated one of plurality of capacitive loads at one end electrode. The each of main switch sections is connected with an output electrode of the drive section and others of the plurality of main switch sections at another end electrode.

In the capacitive load driving circuit, the each of main switch sections may be configured to include a first switch element and a second switch element connected with each other in series as the plurality of switch elements. The second switch element may be connected with associated one of the plurality of capacitive loads at one electrode as a fourth electrode. The second switch element may be connected with the first switch at another electrode as a third electrode. The first switch element may be connected with the second switch element at one electrode as a second electrode. The first switch element may be connected with the output electrode of the drive section at another electrode as a first electrode.

In the capacitive load driving circuit, the each of main switch sections may be configured to further include a capacitive element connected with at least one of the second electrode and the third electrode.

In the capacitive load driving circuit, the each of main switch sections may be configured to further include a sub-switch section as a switch, connected with at least one of the second electrode and the third electrode at one electrode, and a power source at another electrode.

In the capacitive load driving circuit, a voltage which the power source applies to the each of main switch sections may be approximately a half of a maximum voltage of the drive signals.

In order to achieve still another aspect of the present invention, the present invention provides a display panel driving method including: (a) providing a display panel driving circuit; (b) selecting one of the plurality of data lines; (c) applying a predetermined voltage to selected one of the plurality of data lines; (d) connecting the selected one of data lines with associated one of the plurality of liquid crystal cells; (e) outputting a picture signal to the one of selected data lines during stopping the step (c). The display panel driving circuit includes a plurality of gate lines, a plurality of data lines and a plurality of liquid crystal cells. The plurality of gate lines is configured to extend to a first direction. The plurality of data lines is configured to extend to a second direction different form the first direction. The plurality of liquid crystal cells is configured to be placed in positions corresponding to cross-over points between the plurality of gate lines and the plurality of data lines.

In the display panel driving method, the display panel driving circuit may further include a plurality of capacitive elements, each of which configured to be connected with associated one of plurality of data lines, in the step (a). The step (c) may include (c1) applying the predetermined voltage to the selected one of data lines and the associated one of plurality of capacitive elements.

In the display panel driving method, the predetermined voltage may be approximately a half of a maximum voltage of the drive signal.

In the display panel driving method, the predetermined voltage may be around a voltage in which a ratio of a change of transmittance to a change of an applied voltage to each of the plurality of liquid crystal cells is maximum.

In order to achieve another aspect of the present invention, the present invention provides a display panel, including: a plurality of data lines; a terminal which receives an image signal; and a plurality of switch sections each coupled between a corresponding one of the data lines and the terminal, the switch section. The switch sections each has a plurality of transistors formed on an insulating substrate. The plurality of transistors of the switch section is coupled in series between the corresponding one of the data line and the terminal.

In the panel, a connection node of the transistors is selectively supplied with a predetermined voltage.

In the panel, the transistor is a thin film transistor (TFT).

In the panel, the transistor is an organic transistor.

In the panel further including an output circuit which outputs the image signal.

DESCRIPTION OF THE PREFERRED EMBODIMENTS

Embodiments of a capacitive load driving circuit, a display panel driving circuit, a display, and a display panel driving method of the present inventions will be described below with reference to the attached drawings.

First Embodiment

Firstly, the display panel driving circuit (the capacitive load driving circuit) in a first embodiment of the present invention will be described bellow with reference to attached drawings.

Figure 4:
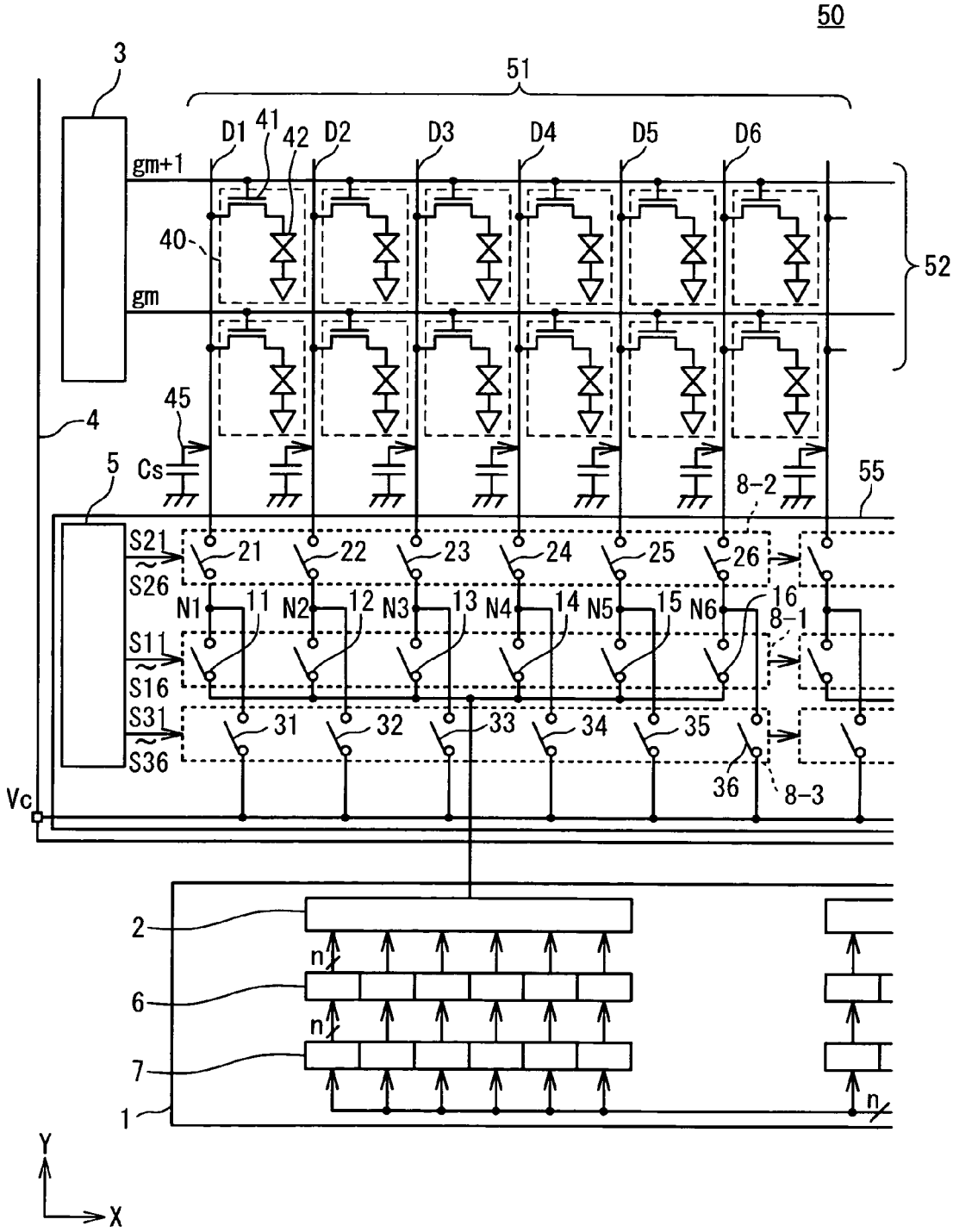
FIG. 4 is a circuit diagram showing a configuration of the display panel driving circuit of the present invention.

FIG. 4 is a circuit diagram showing a configuration of the display panel driving circuit (capacitive load driving circuit) of the present invention. A driving circuit 50 in the display panel of the present invention includes a data driver IC 1 and a liquid crystal display panel 4. The liquid crystal display panel 4 includes a plurality of data lines 51, a plurality of gate lines 52, a plurality of pixels 40, a data line control unit 55, and a gate driver 3.

The plurality of gate lines 52 extends in a X direction (a first direction) in parallel to each other being placed in a predetermined length apart. One end of each gate line 52 connects the gate driver 3. The plurality of data lines 51 extends in a Y direction (a second direction) in parallel to each other being placed in a predetermined length apart. One end of each data line 51 connects the data line control unit 55. Each set of six data lines D1 to D6 configures a data line array.

The plurality of pixels 40 is provided in each position corresponding to each of crossover points between the plurality of gate lines 52 and the plurality of data lines 51. Each pixel 40 has a pixel switch 41 and a liquid crystal cell 42. The pixel switch 41 switches ON or OFF an electric connection between the data line and the liquid crystal cell 42. The pixel switch 41 is exemplifies as a transistor. The transistor may include a gate connected with the gate line 52 and a source connected with the data line 51, and a drain connected with the liquid crystal cell 42. However, the transistor may be another kinds such as a switch circuit element. The liquid crystal cell 42 is a capacitive element including a liquid crystal to configure a pixel of the liquid crystal display panel 4. One electrode is connected with the drain in the above-mentioned. Another electrode is positioned on the opposing substrate.

The gate driver 3 selects one gate line 52 as a selected gate line 52 from the plurality of gate lines 52. The pixel switch 41 on the selected gate line 52 turns on by the selection.

The data line control unit 55 selects one data line 51 as a selected data line 51 from the plurality of data lines 51. The data line control unit 55 includes a first switch unit 8-1, a second switch unit 8-2, a third switch unit 8-3, and a switch control unit 5. As for the data lines D1 to D6 in each data line array, each end in the side of the data line control unit 55 connects one end of each switch 21 to 26 of the second switch unit 8-2. The other end of the switches 21 to 26 connects one end of each switch 11 to 16 of the first switch unit 8-1 respectively in series. The other end of the switches 11 to 16 is commonly connected, and the common connection is connected with an output circuit 2 of a data driver IC 1.

The selected data line 51 is selected by ON/OFF of the switches 11 to 16 connected in series and the switches 21 to 26 corresponding to the switches 11 to 16. The ON/OFF by a switch row composed of the switches 11 to 16 is controlled respectively based on control signals S11 to S16 outputted from the switch control unit 5. Also, the ON/OFF by a switch row composed of the switches 21 to 26 is controlled respectively based on control signals S21 to 26 outputted from the switch control unit 5.

Middle points N1 to N6 are on wirings that connect the switches 11 to 16 and the switches 21 to 26. One end of each switch 31 to 36 of the third switch unit 8-3 is connected with the middle points N1 to N6 respectively. The other ends of the switches 31 to 36 are commonly connected. The common connection is connected with a DC bias voltage source Vc. ON/OFF of the switch row composed of the switches 31 to 36 is controlled based on control signals S31 to S36 of the switch control unit 5.

The switches 11 to 16 and the switches 21 to 26 are exemplified as the transistors. The transistors may be thin film transistors, organic transistors, thin film organic transistors and the like. The transistors are formed on an insulating substrate such as a glass substrate, a plastic substrate and the like. The above-mentioned transistors formed on the liquid crystal display panel 4 (the insulating substrate) tend to leak an electric current more easily than those formed on a semiconductor substrate. The present invention can avoid the leakage of the electric current.

The driver IC 1 includes a data register 7, a latch 6, and the output circuit 2. The data register 7 stores sequentially digital picture signals of n bits that are outputted from the outside in the time series. The latch 6 maintains the digital picture signals outputted from the data register 7. Then, the latch 6 outputs the digital picture signals to the output circuit 2 in the time series. The output circuit 2 converts the digital picture signals into analog picture signals in response to the digital picture signal. Then, the output circuit 2 outputs the analog picture signals to the liquid crystal display panel 4 in a predetermined timing. The analog picture signals are the signals that drive the data line 51.

In FIG. 4, the output circuit 2 is formed on the driver IC 1. However, the output circuit 2 may be formed on the liquid crystal display panel 4.

Next, an operation of the first embodiment of the display panel driving circuit (the capacitive load driving circuit) according to the present invention will be described.

Firstly, an input operation of display data to the driver IC 1 will be described with reference to FIG. 4. The data register 7 receives the digital picture signals of n bits from the outside sequentially in the time series. After receiving the digital picture signals for one gate line, the data register 7 forwards the digital picture signals to the latch 6. Here, suppose that the latch 6 stores digital picture signals R(m, 1), G(m, 1), B(m, 1), R(m, 2), G(m, 2) and B(m, 2) to drive six pixels 40. The six pixels 40 are placed in the positions corresponding to the crossover points between a gate line gm and the data lines D1 to D6.

Figure 5:
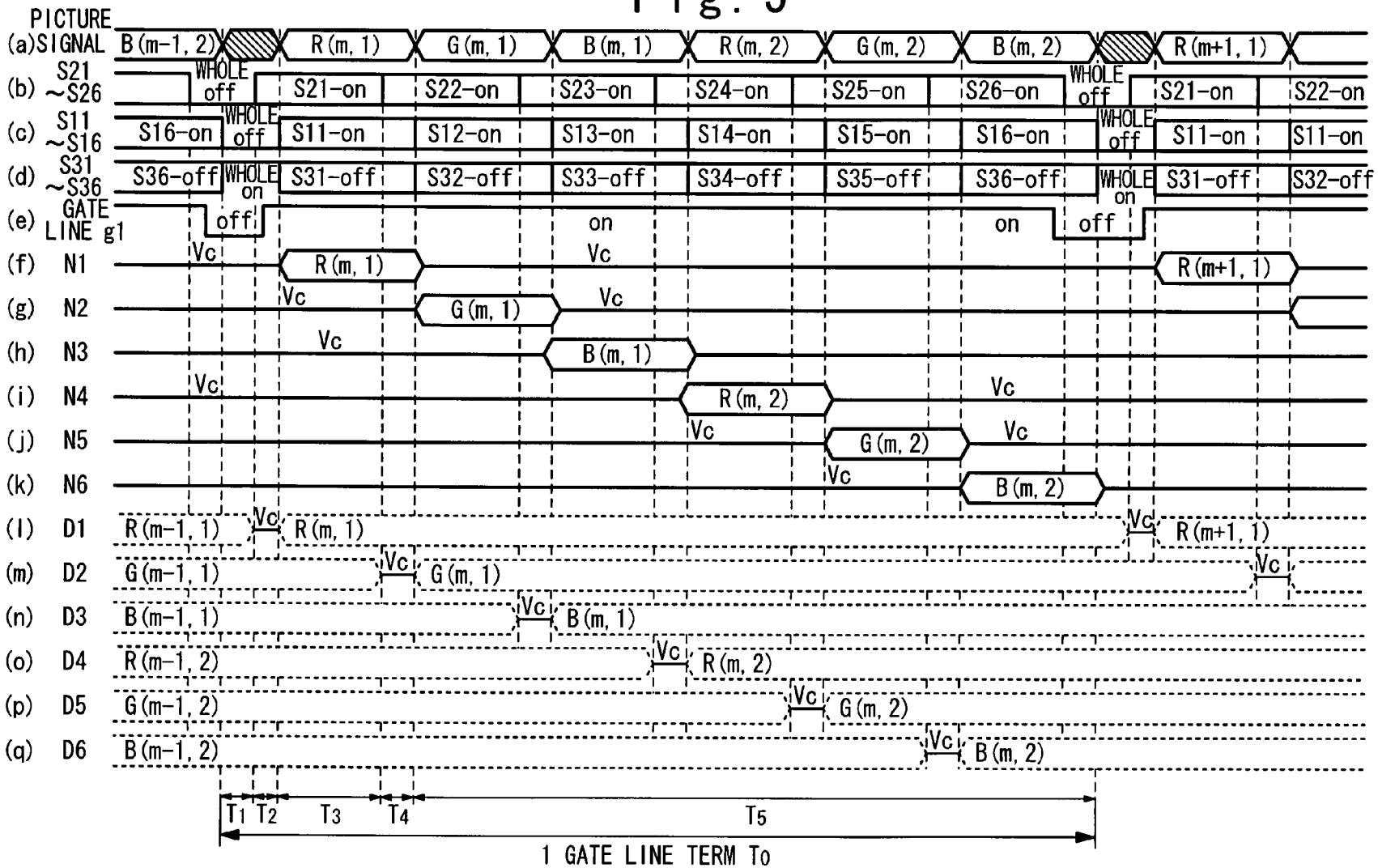
FIG. 5 is a timing chart showing the operation of the first embodiment of the display panel driving circuit according to the present invention.

FIG. 5 is a timing chart showing the operation of the first embodiment of the display panel driving circuit (the capacitive load driving circuit) according to the present invention. FIG. 5(*a*) shows the picture signals (R, G, B). FIG. 5(*b*) shows the control signals (S21 to S26). FIG. 5(*c*) shows the control signals (S11 to S16). FIG. 5(*d*) shows the control signals (S31 to S36). FIG. 5(*e*) shows the signals in the gate line g1. FIGS. 5(*f*) to 5(*k*) show the potential of the nodes N1 to N6. FIGS. 5(*l*) to 5(*q*) show the signals in the data line D1 to D6. The latch 6 outputs the stored digital picture signals of R(m, 1), G(m, 1), B(m, 1), R(m, 2), G(m, 2) and B(m, 2) to the output circuit 2 in this order with time-sharing manner. The following explanation is mainly focused on an operation with respect to the data line D1.

(Term T1)

In an initial state, the switches 11 to 16 and the switches 21 to 26 are in OFF state, and the switches 31 to 36 are in ON state according to the control of the switch control unit 5. As a result, DC bias voltage Vc is applied to the nodes N1 to N6.

(Term T2)

The switch control unit 5 turns on the switch 21. As a result, the DC bias voltage Vc is applied to the data line D1. The voltage level of the bias voltage Vc is assumed to be a level around the middle of the amplitude of the picture signal voltage. The voltage level is preferably around such voltage that the most rapid change occurs in the brightness corresponding to the change of the voltage applied to the liquid crystal cell 42. It should be noted that the gate driver 3 may select the gate line gm, and turn on the pixel transistor 41 connected with this gate line gm in this term.

(Term T3)

The output circuit 2 outputs the analog picture signal R(m, 1) for the data line D1 in response to the operation of the latch 6. The switch control unit 5 let the switch 31 in OFF state and the switch 11 in ON state, synchronizing with the output of the analog picture signal R(m, 1). Thus, the picture signal R(m, 1) is written in the data line D1. Moreover, in the case that the gate line gm has been already selected in the term T2, the picture signal R(m, 1) is also written in the liquid crystal cell 42 via the pixel transistor 41. Here, the ON state of the switch 11 is controlled so as not to coincide with the ON state of the switch 31 at the same time.

(Term T4)

The switch control unit 5 turns off the switch 21 before the output picture signal of the output circuit 2 changes from R(m, 1) to G(m, 1). As a result, the picture signal R(m, 1) written in the data line D1 is maintained because the data line D1 is a capacitive load in the light of the output circuit 2. Continuously, the switch control unit 5 turns on the switch 22 after turning off the switch 21.

(Term T5)

The switch control unit 5 turns off the switch 11 and turns on the switch 31 in order to apply the DC bias voltage Vc to the node N1 again. In this time, the voltage of ((the picture signal voltage of R(m, 1))−(the DC bias voltage Vc)) is applied between both terminals of the switch 21. Continuously, the switch control unit 5 turns off the switch 32 and turns on the switch 12 in order to execute the writing operation for the data line D2 same as the term T3. Here, the DC bias voltage Vc may be applied to the node N1 through a resistive element having a resistance negligible for writing operation. As a result, an excessive electric current can be restricted when the DC bias voltage is applied to the node N at the turning on the switch 31. The picture signals are written in the data lines D3 to D6 similarly in following processes. Then, letting the gate line gm in the non-selection state before the switch 26 is turned off. The process of writing the picture signals is completed in the liquid crystal cells 42 corresponding to the data lines D1 to D6.

The above-mentioned operation is executed at the same time concurrently on another data line array that is next to the data line array of the above-mentioned data lines D1 to D6.

The timing of selecting of the gate line gm is not limited to the term T2. That is, the timing may be any timing from turning on the switch 21 to turning off the switch 16. Moreover, the timing of non-selecting of the gate line gm may be any timing from selecting of the gate line gm to turning on the switch 21 again when selecting of the next gate line gm+1.

Figure 1:
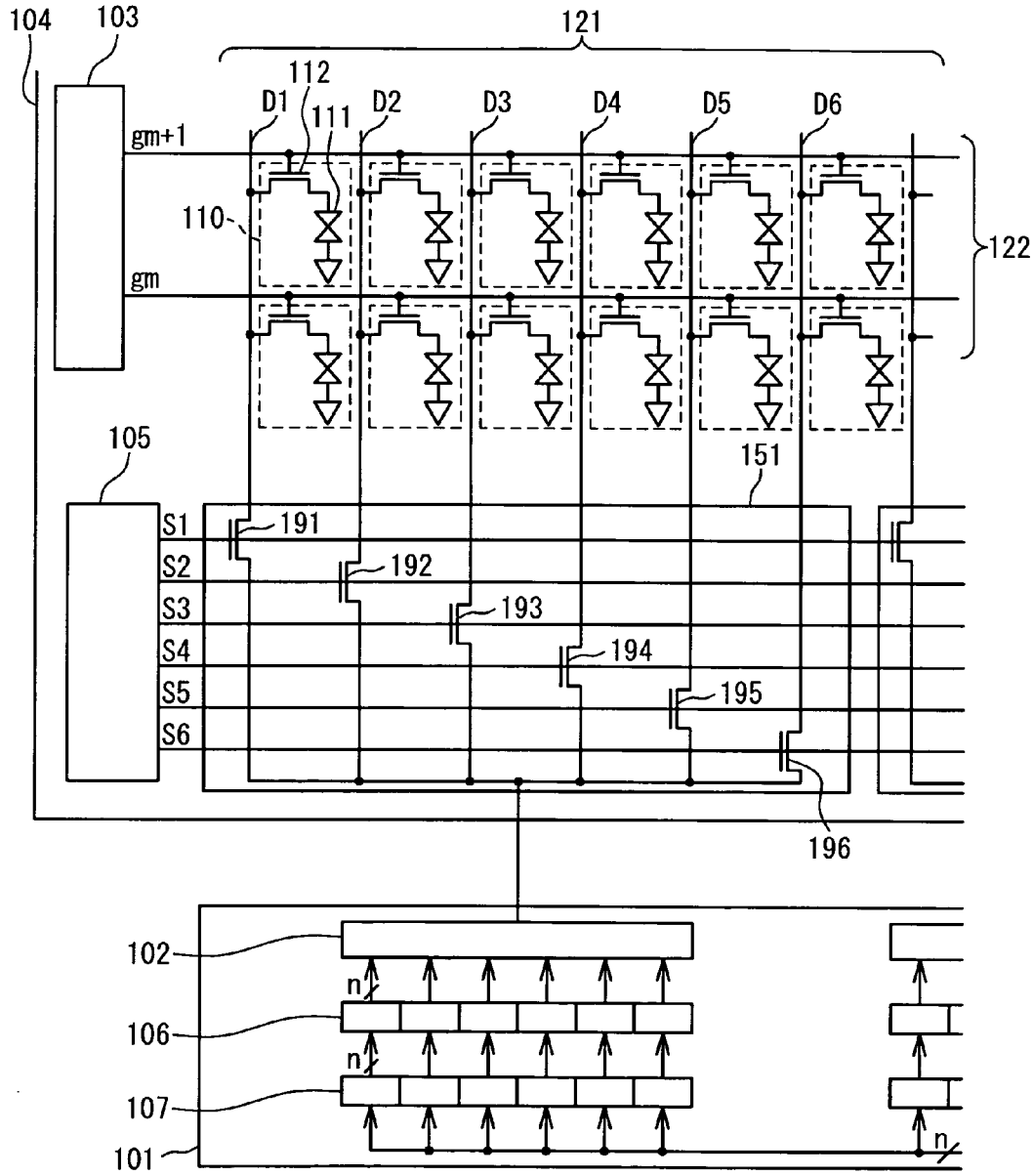
Fig. 1 PRIOR ART
FIG. 1 is a circuit diagram showing a configuration of a driving circuit of the conventional display panel.
Figure 2:
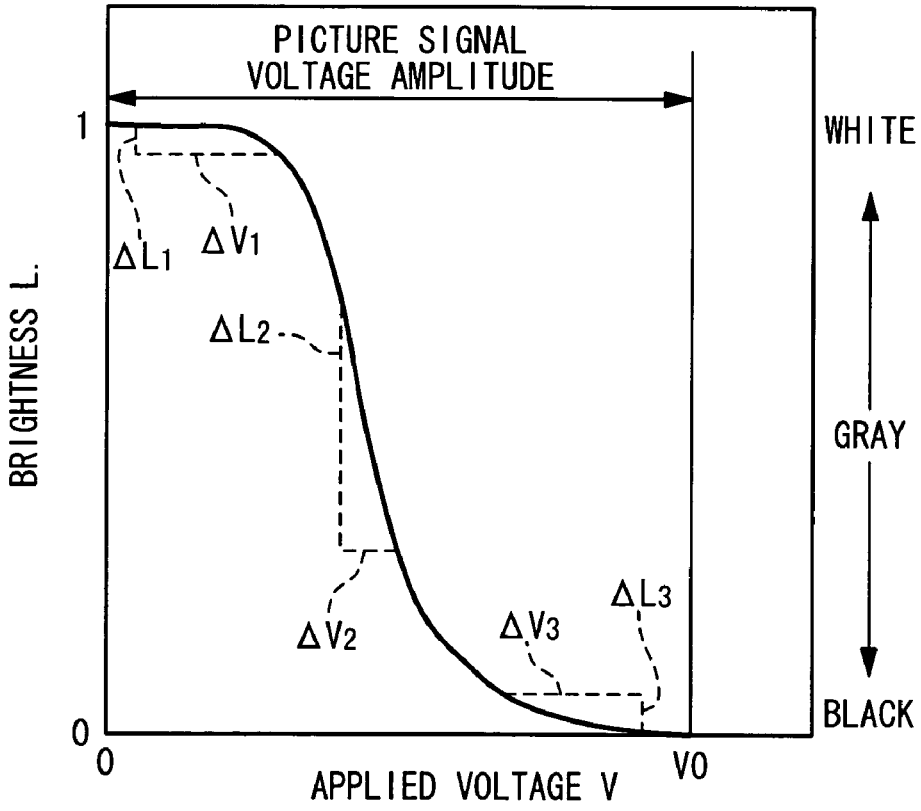
Fig. 2 PRIOR ART
FIG. 2 is a graph showing a general relation between a brightness and applied voltage of the liquid crystal display cell.

The liquid crystal cell 42 can be considered to be a capacitive load. Therefore, in the case of the data line D1, the data line D1 maintains the applied voltage corresponding to the written picture signal R(m, 1) in the terms T4 and T5 because the switch 21 is in OFF state. Among these, a potential difference is not generated between both terminals of the switch 21 in the term T4. In the term T 5, the DC bias voltage Vc is applied to the node N1. As mentioned above, the DC bias voltage Vc is preferably around such voltage that the most rapid change occurs in the brightness corresponding to the change of the applied voltage of the liquid crystal cell 42. This is the applied voltage that $\Delta L/\Delta V$ becomes maximum ($=\Delta L2/\Delta V2$) in FIG. 2. Therefore, when writing picture signals having such the applied voltage (for example, a halftone), the voltage between both terminals of the switch 21 can be minimized. That is, the leakage current of the switch 21 can be reduced most at this time.

Figure 6:
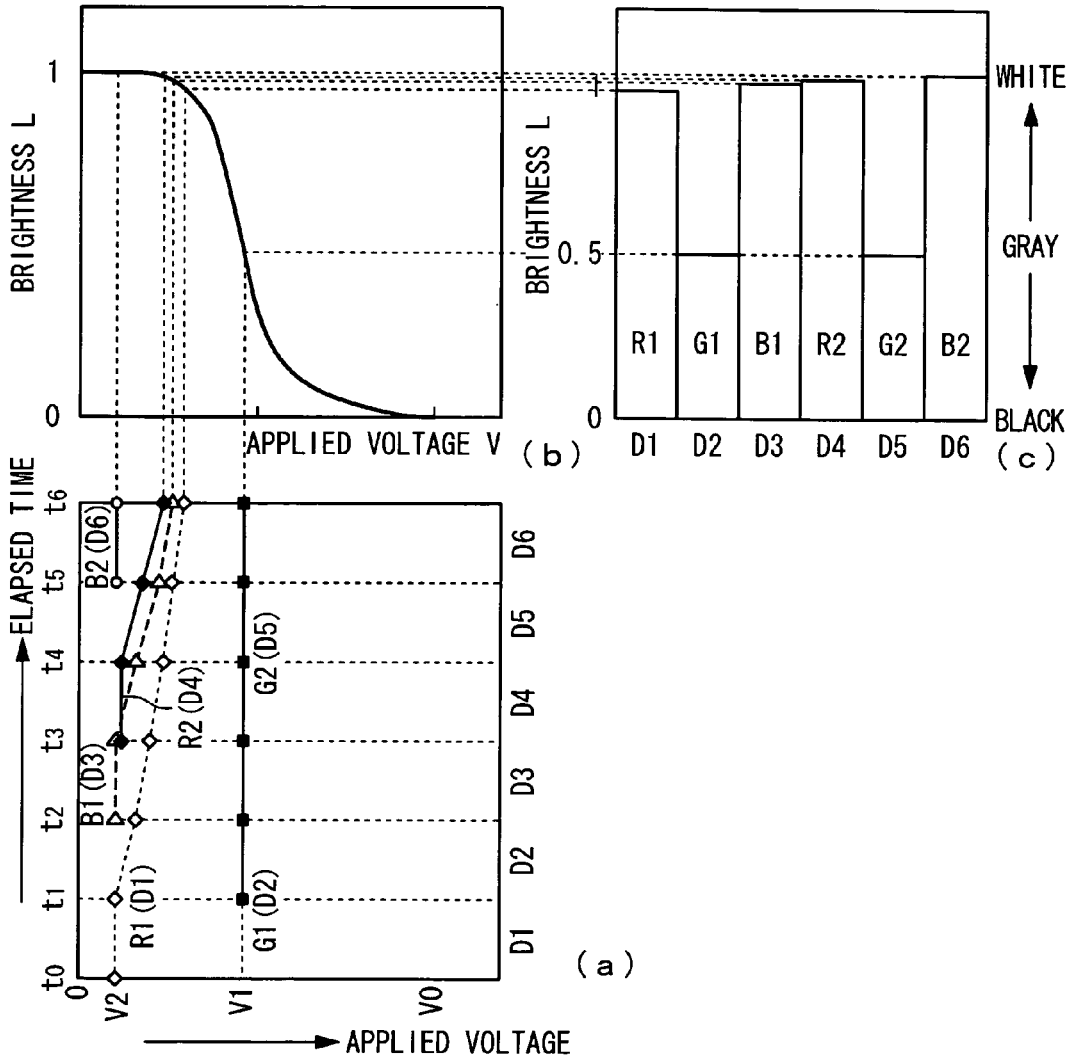
FIG. 6 is graphs showing the change of the brightness of the driving circuit in the display panel of the first embodiment according to the present invention.

FIG. 6 is graphs showing the change of the brightness of the driving circuit in the display panel of the first embodiment according to the present invention. FIG. 6(*a*) shows the drive voltages (the picture signal voltages) and their voltage changes. Here, the drive voltages (the picture signal voltages) are respectively applied to the data lines D1 to D6 by the six time-sharing drive. The voltage change is the changes of voltage in the data lines when the data lines are in the non-selection state and maintains the written picture signal voltage after the driving. A vertical axis indicates elapsed times, and a horizontal axis indicates the picture signals voltage (the applied voltage). A line chart is described for each data line D1 to D6. FIG. 6(*b*) shows the relation between the brightness and the applied voltage of the liquid crystal cell. A vertical axis indicates the brightness L and a horizontal axis indicates the voltages of the picture signal (the applied voltage). FIG. 6(*c*) shows the change of the brightness of the liquid crystal cell according to the voltage change of the maintained picture signal voltage (the applied voltage) in each data line. A vertical axis indicates the brightness L and a horizontal axis indicates the data line. The liquid crystal cell in this example is operated in normally white mode.

Here, a following operation shown in FIG. 6(*a*) is assumed as an example. That is, at t=t0, a picture signal R1 having the applied voltage V2 of the highest gradation is written in the data line D1. At t=t1, a picture signal G1 having the applied voltage V1 of halftone is written in the data line D2. At t=t2, a picture signal B1 having the applied voltage V2 of the highest gradation is written in the data line D3. Then, at t=t3 to t5, the same signal pattern as the data lines D1 to D3 are repeatedly written in the data lines D4 to D6 for wiring of the picture signals.

As shown in FIG. 6(*a*), in a data line D2 selection term (that is, "D2": t=t1 to t2), the voltage V2 (the picture signal voltage) written in the data line D1 becomes in a maintenance state. The voltage of the data line D1 is changed by a leakage current of a switching element 21, being pulled to the bias voltage Vc that is the applied voltage of the node N1. In a data line D3 selection term (that is "D3": t=t2 to t3), the Voltage V2 (the picture signal voltage) written in the data line D1 is further changed being pulled to the bias voltage Vc. At this time, the voltage V1 (the picture signal voltage) written in the data line D2 has the almost same voltage as the bias voltage Vc. Therefore, the voltage V1 (the picture signal voltage) hardly changes because the leakage current of the switch 22 becomes very small. Thus, the maintenance voltage of the data line (for example: D1), to which the picture signal having the different voltage (for example V2) from the bias voltage Vc is written, is being changed toward the bias voltage Vc. However, the maintenance voltage of the data line (for example: D2), to which the picture signal having the writing voltage (for example: V1) close to the bias voltage Vc is written, is not changed. That is, the change of the maintenance voltage is extremely small.

FIG. 6(*c*) is corresponded to the above-mentioned voltage change shown in FIG. 6(*a*). That is, in the gray gradation (the halftone) corresponding to the picture signal voltage around the bias voltage Vc (for example: V1), the brightness change can be extremely reduced rather than the conventional case shown in FIG. 3 without depending on the maintenance time. Because, the change of the maintenance voltage is small in the data line with the gray gradation. On the other hand, in the white or black gradation corresponding to the picture signal voltage (for example: V2), the maintenance voltage is changing comparatively large according to the time elapse. However, because of the characteristic of the liquid crystal cell shown in FIG. 6(*b*), the brightness is hardly influenced by the applied voltage. Therefore, the change of the brightness can be reduced.

Moreover, as shown in a timing chart in FIG. 5, the data lines D1 to D6 are written so as to be in the DC bias voltage Vc level immediately before writing the picture signals. As a result, the voltage change due to the picture signal voltage in each of the liquid crystal cells and the data lines can be reduced. That is, the present invention also has an effect as the pre-charge circuit. As a result, the efficiency for writing to the data lines can be improved, even when writing picture signals of which the voltage changes greatly in each display frame.

According to the present invention, the leakage current of the data line can be restricted in each data line by the switching element connected in series. As a result, the picture signal voltage in the data line can be stably maintained in the single-color halftone and the two-color halftone. That is, it is possible to reduce the unevenness brightness between the data lines, and reduce the unevenness display such as the vertical unevenness in the single-color halftone display or the two-color halftone display. It is also possible to improve a display picture quality more than the conventional sharing drive method. It is possible to enjoy merits of downsizing of the chip of the data driver IC.

Second Embodiment

Hereinafter, the second embodiment of the display panel driving circuit (the capacitive load driving circuit) according to the present invention will be described bellow with reference to the attached drawings.

Figure 7:
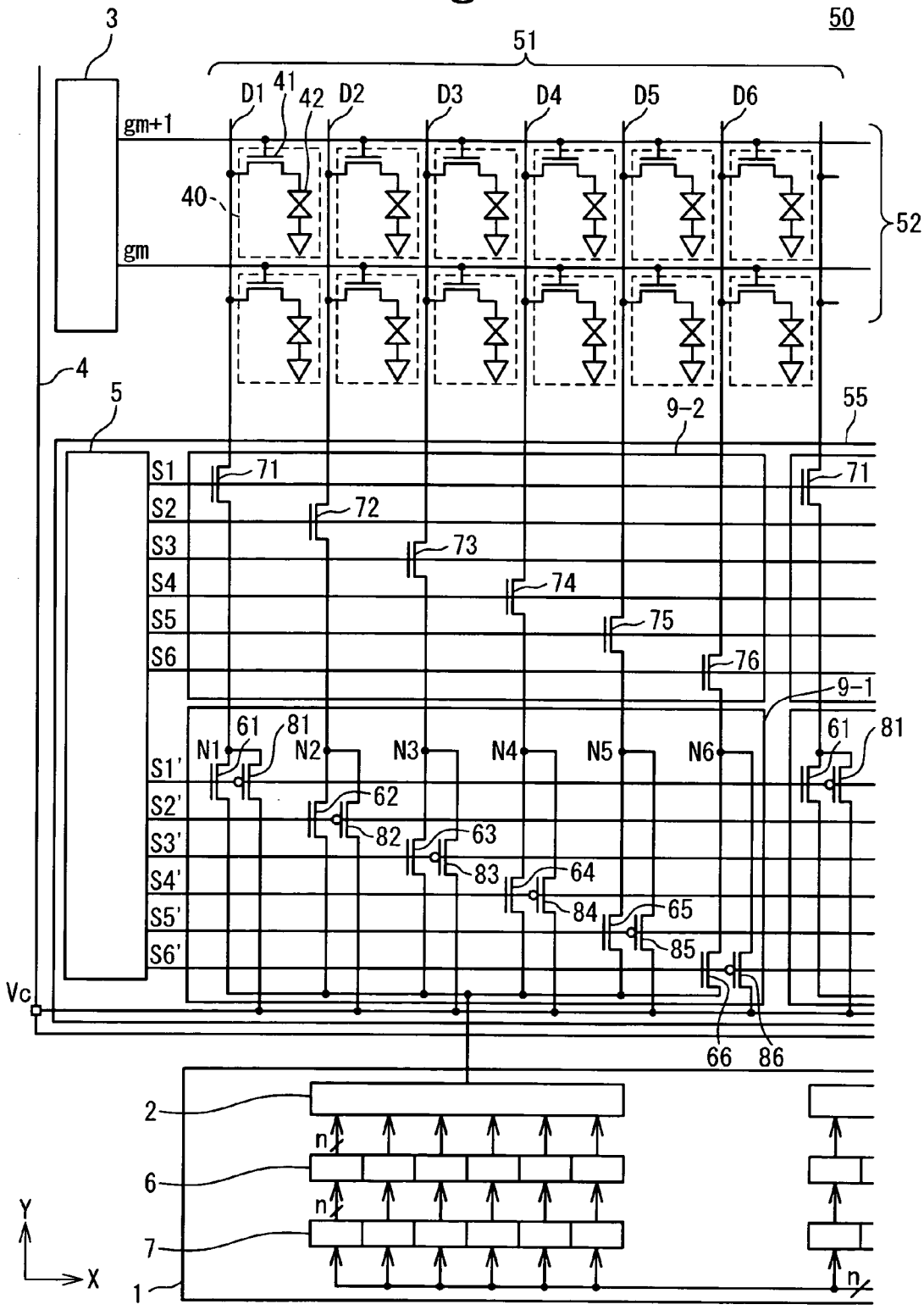
FIG. 7 is a circuit diagram showing a configuration of the second embodiment of the display panel driving circuit according to the present invention.

FIG. 7 is a circuit diagram showing a configuration of the second embodiment of the display panel driving circuit (capacitive load driving circuit) according to the present invention.

The difference with the first embodiment is that the switches 11 to 16, the switches 21 to 26, and the switches 31 to 36 are configured by thin film transistors (Hereafter referred to as TFTs). By using the TFTs, these switches and the pixel switches 41 can be formed on the same substrate at the same manufacturing process of the liquid crystal display panel 4. As for the switch control unit 5, it is possible to form a circuit by using TFTs in the same process as the above-mentioned.

In this embodiment, TFTs 61 to 66 of a first switch unit 9-1 are arranged corresponding to the switches 11 to 16 of the first switch unit 8-1. TFTs 71 to 76 of a second switch unit 9-2 are arranged corresponding to the switches 21 to 26 of the second switch unit 8-2. TFTs 81 to 86 of the first switch unit 9-1 are arranged corresponding to the switches 31 to 36 of the third switch unit 8-3. In this time, the control signals S1' to S6' correspond to the control signals S11 to S16 of the switch control unit 5, the control signals S1 to S6 correspond to the control signals S21 to S26, and the control signals S1' to S6' correspond to the control signals S31 to S36.

It should be noted that the TFTs 61 to 66 and the TFTs 71 to 76 are configured by N-ch TFTs, and the TFTs 81 to 86 are configured by P-ch TFTs in the second embodiment. However, the present invention is not limited to this configuration. Opposite conductive type TFTs can be used or a N-ch TFT and a P-ch TFT can be combined as a complementary type device.

The configuration and the operation other than the above-mentioned in the second embodiment are the same as those of the first embodiment. Therefore, the explanations for them are omitted.

The same effect as in the first embodiment can be also obtained in the second embodiment.

Additionally, according to the second embodiment, the TFTs 61 to 66, the TFTs 71 to 76, and the TFTs 81 to 86 are possible to be manufactured in the same process as the liquid crystal display panel 4. Therefore, the above-mentioned effect can be achieved without increasing the number of the processes in the manufacturing of the liquid crystal display panel 4.

The number of switches for the sharing drive of the data lines is needed three times larger than that of the conventional technique as well as the first embodiment. However, a wire pitch of the data line of the liquid crystal display panel 4 is as large as 150 μm to 300 μm in a direct-view type liquid crystal display. Therefore, even though the switches needed in the present invention are arranged, the area of the entire display panel increases a little. As a result, the above-mentioned effect can be obtained almost without increasing area of the display panel and cost of the display panel. Then, it is possible to enjoy merit of downsizing the chip (miniaturizing the chip size) of the data driver IC.

Third Embodiment

Hereinafter, the third embodiment of the display panel driving circuit (the capacitive load driving circuit) according to the present invention will be described bellow with reference to the attached drawings.

Figure 8:
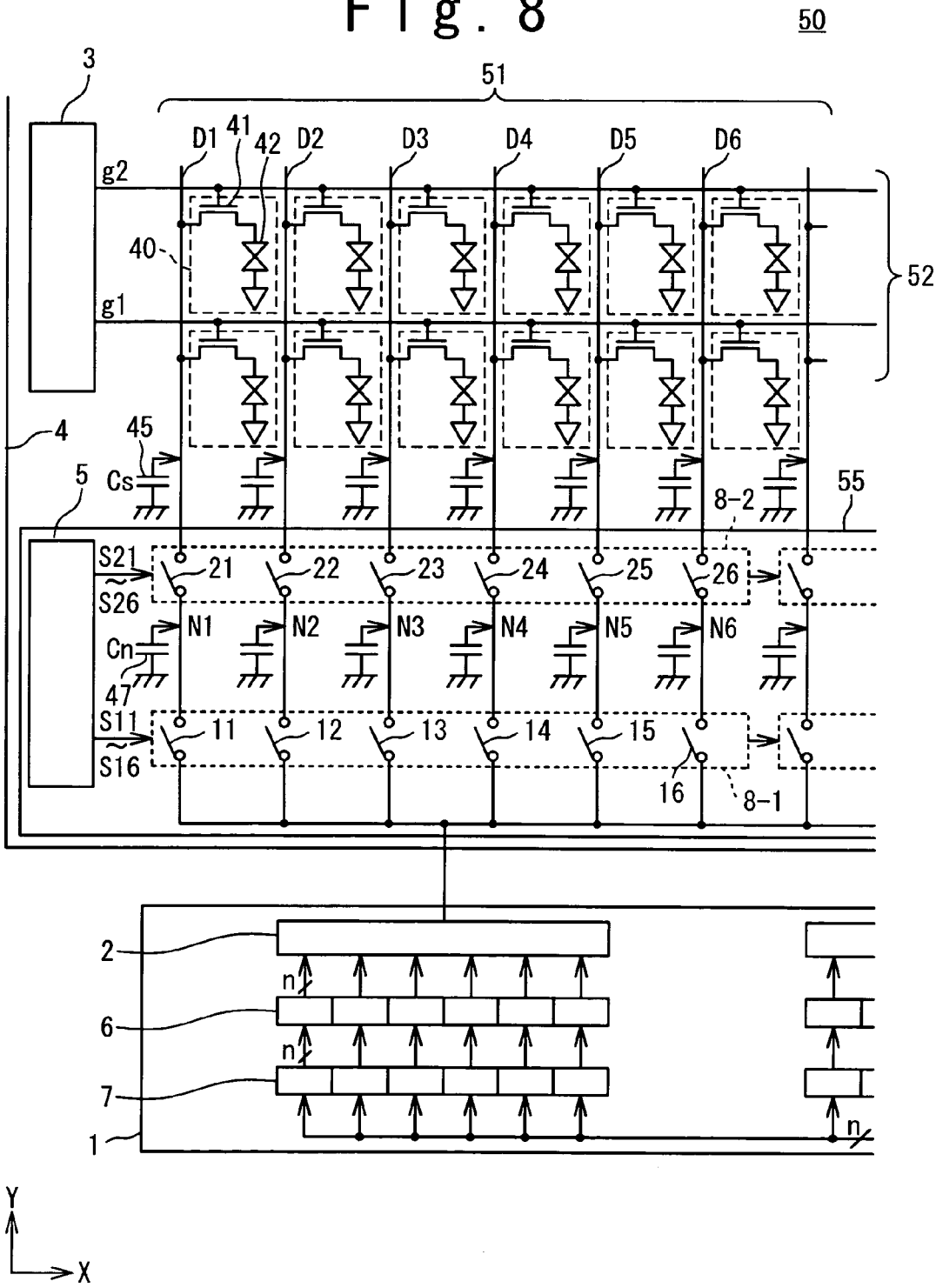
FIG. 8 is a circuit diagram showing a configuration of the third embodiment of the display panel driving circuit according to the present invention.

FIG. 8 is a circuit diagram showing a configuration of the third embodiment of the display panel driving circuit (the capacitive load driving circuit) according to the present invention.

The difference with the first embodiment is that the switches 31 to 36 and the DC bias voltage source Vc are deleted. The configuration of the third embodiment is same as that of the first embodiment other than the above-mentioned. Therefore, the explanation is omitted.

Next, an operation of the third embodiment of the display panel driving circuit (the capacitive load driving circuit) according to the present invention will be described.

Firstly, an input operation of display data to the driver IC 1 will be described with reference to FIG. 8. The data register 7 receives the digital picture signals of n bits from the outside sequentially in the time series. After receiving the digital picture signals for one gate line, the data register 7 forwards the digital picture signals to the latch 6. Here, suppose that the latch 6 stores digital picture signals R(m, 1), G(m, 1), B(m, 1), R(m, 2), G(m, 2) and B(m, 2) to drive six pixels 40. The six pixels 40 are placed in the positions corresponding to the crossover points between a gate line gm and data lines D1 to D6.

Figure 9:
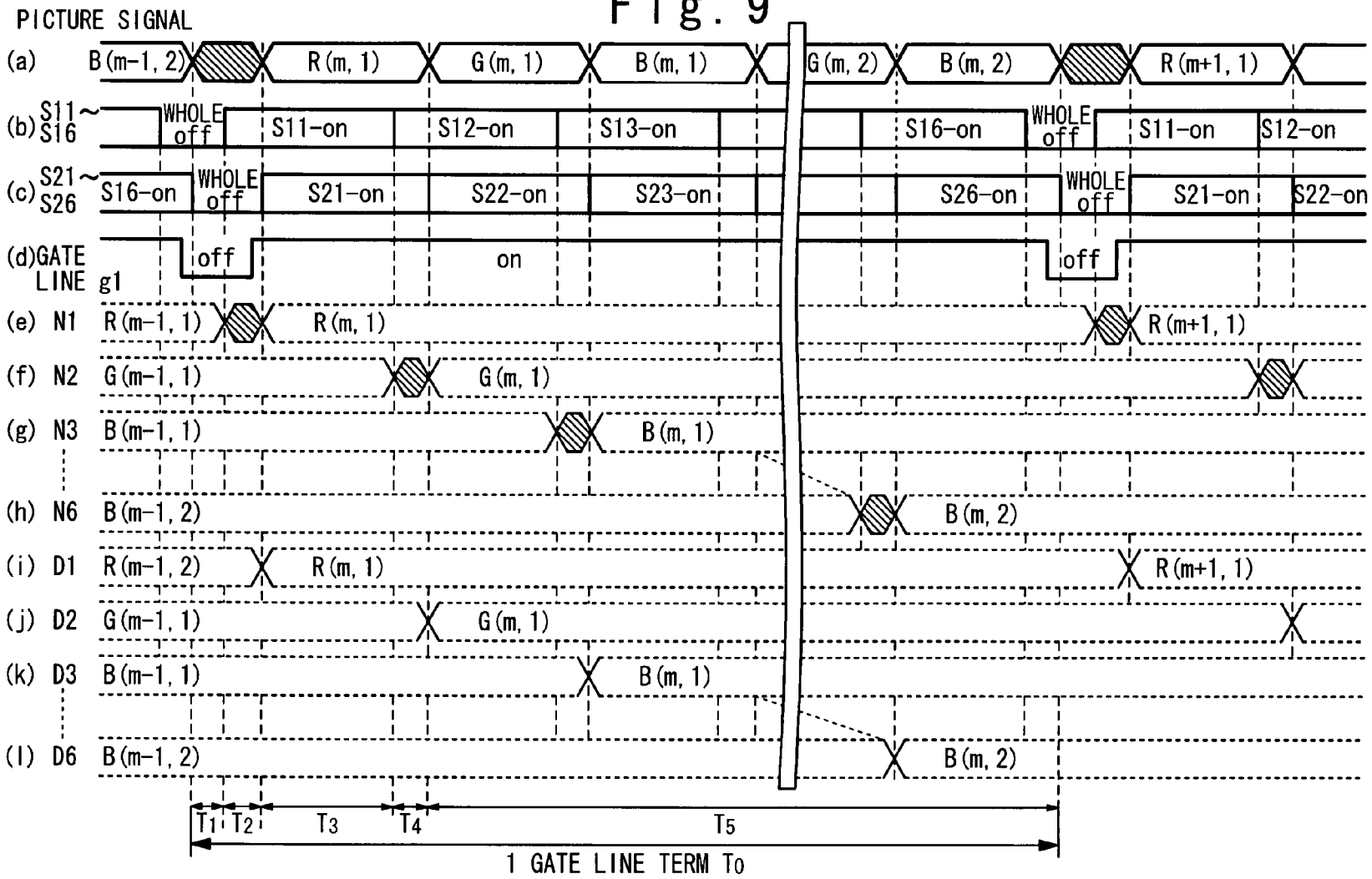
FIG. 9 is a timing chart showing the operation of the third embodiment of the display panel driving circuit according to the present invention.

FIG. 9 is a timing chart showing the operation of the third embodiment of the display panel driving circuit (the capacitive load driving circuit) according to the present invention. FIG. 9(*a*) shows the picture signals (R, G, B). FIG. 9(*b*) shows the control signals (S11 to S16). FIG. 9(*c*) shows the control signals (S21 to S26). FIG. 9(*d*) shows the signals in the gate line g1. FIGS. 9(*e*) to 9(*h*) show the potential of the nodes N1, N2, N3, N6. FIGS. 9(*i*) to 9(*l*) show the signals in the data line D1, D2, D3, D6. The latch 6 outputs the stored digital picture signals of R(m, 1), G(m, 1), B(m, 1), R(m, 2), G(m, 2) and B(m, 2) to the output circuit 2 in this order with time-sharing manner. The following explanation is mainly focused on an operation with respect to the data line D1.

(Term T1)

In an initial state, the switches 11 to 16 and the switches 21 to 26 are in OFF state according to a control of a switch control unit 5.

(Term T2)

The switch control unit 5 turns on the switch 11. It should be noted that the gate driver 3 may select the gate line gm and turn on the pixel transistor 41 connected with the gate line gm in this term.

(Term T3)

The output circuit 2 outputs the analog picture signal R(m, 1) for the data line D1 in response to the operation of the latch 6. The switch control unit 5 let the switch 21 in ON state synchronizing with the output of the analog picture signal R(m, 1). Thus, the picture signal R(m, 1) is written in the data line D1. Moreover, in the case that the gate line gm has been already selected in the term T2, the picture signal R(m, 1) is also written in the liquid crystal cell 42 via the pixel transistor 41.

(Term T4)

The switch control unit 5 turns off the switch 11 before the output picture signal of the output circuit 2 changes from R(m, 1) to G(m, 1). As a result, the picture signal R(m, 1) written in the data line D1 and the node N1 is maintained because the data line D1 is a capacitive load in the light of the output circuit 2. Continuously, the switch control unit 5 turns on the switch 12 after turning off the switch 11.

(Term T5)

The switch control unit 5 turns off the switch 21. In this time, the electric charge of the written picture signal R(m, 1) is maintained in a parasitic capacitance Cn 47 of the node N1. Here, a capacitative element may be connected with the node N1 besides the parasitic capacitance. Continuously, the switch control unit 5 turns on the switch 22 in order to execute the writing operation for the data line D2 same as the term T3. The picture signals are written in the data lines D3 to D6 similarly in following processes. Then, letting the gate line gm in not-selection state before the switch 26 is turned off. The process of writing the picture signals is completed in Liquid crystal cells 42 corresponding to the data lines D1 to D6.

The above-mentioned operation is executed at the same time concurrently on another data line array that is next to the data line array of the data lines D1 to D6.

The timing of selecting of the gate line gm is not limited to the term T2. That is, the timing may be any timing from turning on the switch 11 to turning off the switch 26. Moreover, the timing of non-selecting of the gate line gm may be any timing from selecting of the gate line gm to turning on the switch 11 again when selecting of the next gate line gm+1.

In this embodiment, the switch 21 is turned off after the switch 11 is turned off. Therefore, any picture signal voltage written in the floating (parasitic) capacitance Cn (or a provided capacitative element 47) of the node N 1 can be maintained until the switch 21 is turned on again when the gate line gm+1 is selected by the gate driver 3. As a result, a potential difference between both terminals of the switch 21 is not generated. Therefore, a leakage current of the switch 21 can be minimized anytime without depending on the level of the picture signal voltage.

A potential difference between the both terminals of the switch 11A is generated, while the operation proceeds to the term T5. Therefore, it is possible to leak the maintained electric charge of the node N1 to the side of the output circuit 2. However, the time constant of the leakage of the electric charge from the node 1 can be lengthened by connecting the capacitative element 47 having a suitable capacitance value with the node N1. Moreover, the voltage at the node N1 changes gradually based on the written picture signal voltage. Therefore, the potential difference generated between both terminals of the switch 21 can be reduced to all the driving signal voltages compared with the conventional technique. Thus, the leakage can be reduced.

Figure 10:
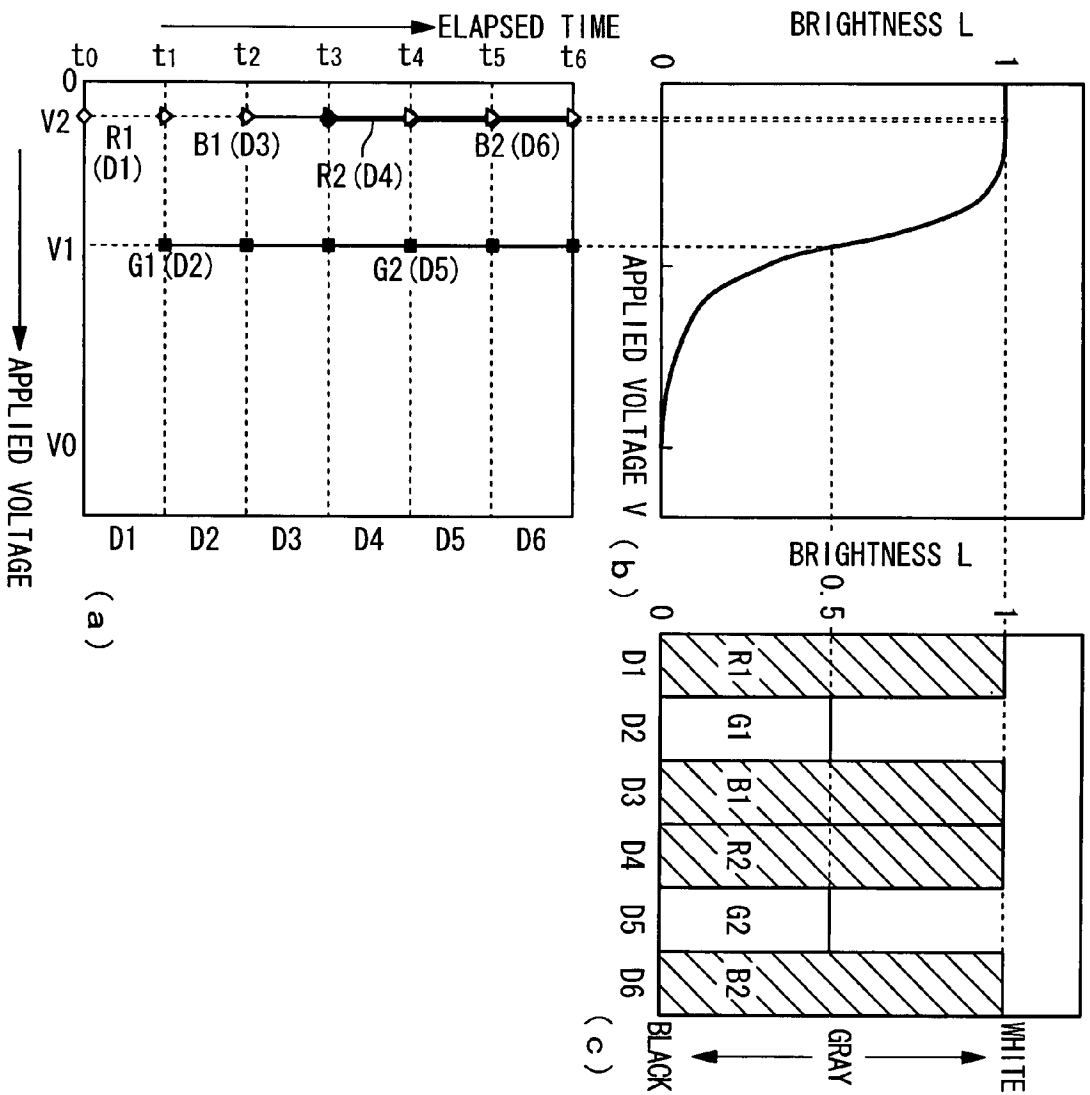
FIG. 10 is graphs showing the change of the brightness of the driving circuit in the display panel of the first embodiment according to the present invention.

FIG. 10 is graphs showing the change of the brightness of the driving circuit in the display panel of the first embodiment according to the present invention. FIG. 10(*a*) shows the drive voltages (the picture signal voltages) and their voltage changes. Here, the drive voltages (the picture signal voltages) are respectively applied to the data lines D1 to D6 by the six time-sharing drive. The voltage change is the change of voltage in the data lines when the data lines are in the non-selection state and maintains the written picture signal voltage after the driving. A vertical axis indicates elapsed times, and a horizontal axis indicates the picture signals voltage (the applied voltage). A line chart is described for each data line D1 to D6. FIG. 10(*b*) shows the relation between the brightness and the applied voltage of the liquid crystal cell. A vertical axis indicates the brightness L and a horizontal axis indicates the voltages of the picture signal (the applied voltage). FIG. 10(*c*) shows the change of the brightness of the liquid crystal cell according to the voltage change of the maintained picture signal voltage (the applied voltage) in each data line. A vertical axis indicates the brightness L and a horizontal axis indicates the data line. The liquid crystal cell in this example is operated in normally white mode.

Figure 3:
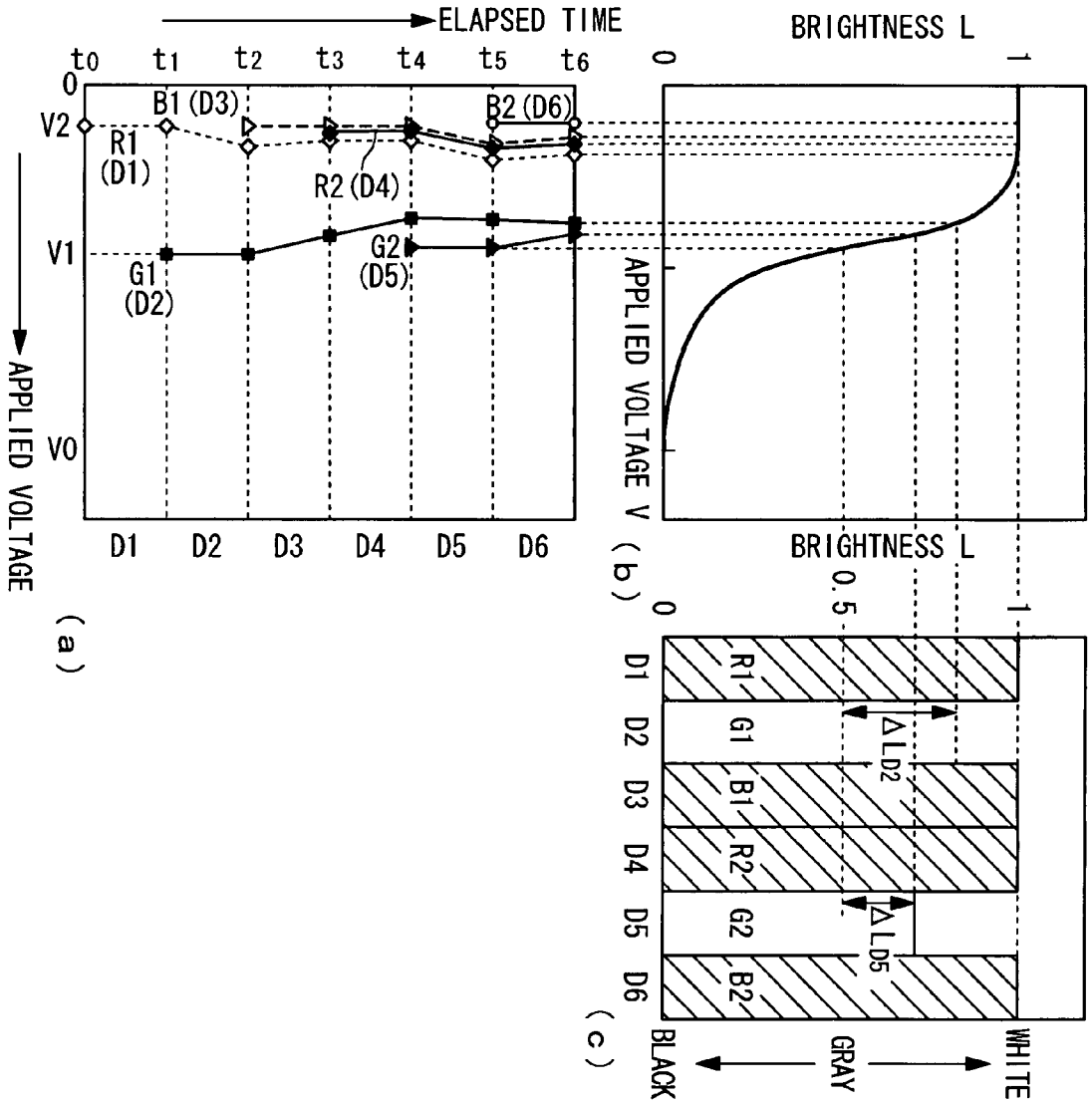
Fig. 3 PRIOR ART
FIG. 3 is graphs showing the change of the brightness of the driving circuit in the conventional display panel.

In this case, as well as FIGS. 3 and 6, a following operation shown in FIG. 10(*a*) is assumed as an example. That is, at t=t0, a picture signal R1 having the applied voltage V2 of the highest gradation is written in the data line D1. At t=t1, a picture signal G1 having the applied voltage V1 of halftone is written in the data line D2. At t=t2, a picture signal B1 having the applied voltage V2 of the highest gradation is written in the data line D3. Then, at t=t3 to t5, the same signal pattern as the data lines D1 to D3 are repeatedly written in the data lines D4 to D6 for wiring of the picture signals.

As shown in FIG. 10, the leakage current of the switches 21 to 26 can be remarkably reduced in the third embodiment. Therefore, the voltage change in any writing voltage within the applied voltage at the liquid crystal cell can be restricted very small. As a result, the change of the brightness can be reduced further in all the gradations.

According to the present invention, the leakage current of the data line can be restricted in each data line by the switching element connected in series. As a result, the picture signal voltage in the data line can be stably maintained in the single-color halftone and the two-color halftone. That is, it is possible to reduce the unevenness brightness between the data lines, and reduce the unevenness display such as the vertical unevenness in the single-color halftone display or the two-color halftone display. It is also possible to improve a display picture quality more than the conventional sharing drive method. It is possible to enjoy merit of downsizing the chip (miniaturizing the chip size) of the data driver IC. Consequently, the display quality in the third embodiment improves further compared with the first and second embodiments.

Fourth Embodiment

Hereinafter, the forth embodiment of the display panel driving circuit (the capacitive load driving circuit) according to the present invention will be described bellow with reference to the attached drawings.

Figure 11:
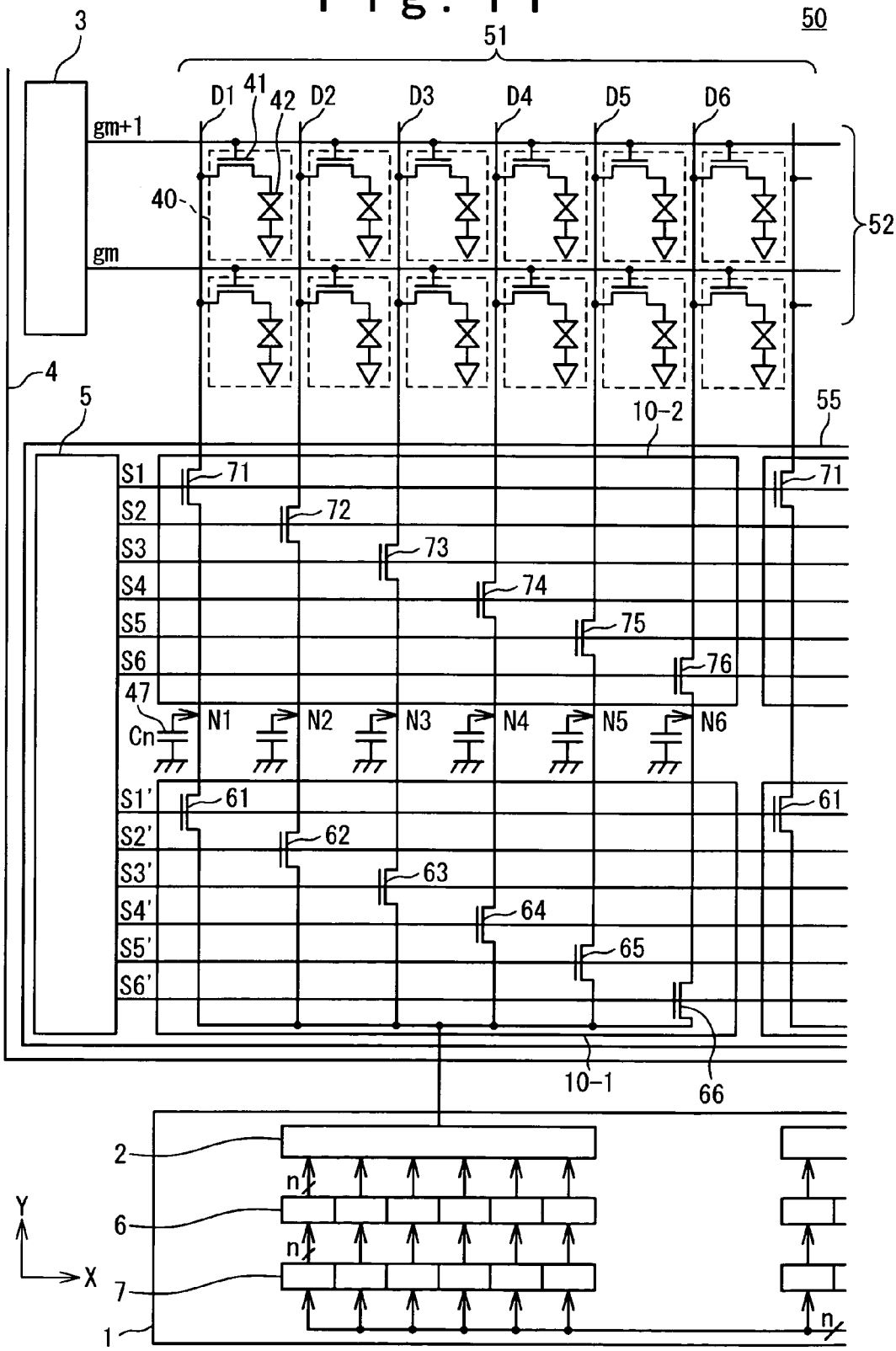
FIG. 11 is a circuit diagram showing a configuration of the forth embodiment of the display panel driving circuit according the present invention.

FIG. 11 is a circuit diagram showing a configuration of the forth embodiment of the display panel driving circuit (capacitive load driving circuit) according the present invention.

The difference with the third embodiment is that the switches 11 to 16 and the switches 21 to 26 are configured by TFTs. By using the TFTs, these switches and the pixel switches 41 can be formed on the same substrate at the same manufacturing process of the liquid crystal display panel 4. As for the switch control unit 5, it is possible to form a circuit by using TFTs in the same process as the above-mentioned.

In this embodiment, TFTs 61 to 66 of a first switch unit 10-1 are arranged corresponding to the switches 11 to 16 of the first switch unit 8-1. TFTs 71 to 76 of a second switch unit 10-2 are arranged corresponding to the switches 21 to 26 of the second switch unit 8-2. In this time, the control signals S1' to S6' correspond to the control signals S11 to S16 of the switch control unit 5, the control signals S1 to S6 correspond to the control signals S21 to S26.

It should be noted that the TFTs 61 to 66 and the TFTs 71 to 76 are configured by N-ch TFTs in the forth embodiment. However, the present invention is not limited to this configuration. Opposite conductive type TFTs can be used or a N-ch TFT and a P-ch TFT can be combined for complementary type device.

The configuration and the operation other than the above-mentioned in the fourth embodiment are the same as the third embodiment. Therefore, explanations for them are omitted.

The same effect as in the third embodiment can be also obtained in the forth embodiment.

Additionally, according to the forth embodiment, the TFTs 61 to 66 and the TFTs 71 to 76 are possible to be manufactured in the same process as the liquid crystal display panel 4. Therefore, the above-mentioned effect can be achieved without increasing the number of the processes in the manufacturing of the liquid crystal display panel 4. The number of switches for the sharing drive of the data lines is needed twice larger than that of the conventional technique as well as the third embodiment. However, in the case of the direct-view type liquid crystal display, the area for the switches needed in the present invention increases little in the entire panel. As a result, the above-mentioned effect can be obtained almost without increasing area of the panel and cost of the panel. Then, it is possible to enjoy merit of downsizing the chip (miniaturizing the chip size) of the data driver IC.

What is claimed is:

1. A display panel driving circuit, comprising:

a plurality of gate lines configured to extend to a first direction;

a plurality of data lines configured to extend to a second direction different from said first direction;

a first selector configured to select a selection gate line from said plurality of gate lines;

a second selector configured to select a selection data line from said plurality of data lines;

a plurality of liquid crystal cells configured to be placed in positions corresponding to crossover points between said plurality of gate lines and said plurality of data lines; and a drive section configured to output drive signals which drive said plurality of liquid crystal cells through said second selector based on inputted picture signals, wherein each of said plurality of liquid crystal cells includes:

a transistor configured to be connected with an associated one of said plurality of gate lines at a gate electrode, and an associated one of said plurality of data lines at one of other two electrodes, and a capacitive element configured to be connected with said transistor at another of said other two electrodes, wherein said second selector includes:

a plurality of main switch sections, and a switch control section configured to control switching on and off of said plurality of main switch sections, wherein each of said plurality of main switch sections includes a plurality of switch elements in series, wherein said each of said plurality of main switch sections is connected with an associated one of said plurality of data lines at one electrode, and wherein said each of main switch sections is connected with an output electrode of said drive section and others of said plurality of main switch sections at another electrode.

2. The display panel driving circuit according to claim 1, wherein said each of said plurality of main switch sections is configured to include a first switch element and a second switch element connected with each other in series as said plurality of switch elements, wherein said second switch element is connected with an associated one of said plurality of data lines at one electrode as a fourth electrode, wherein said second switch element is connected with said first switch at another electrode as a third electrode, wherein said first switch element is connected with said second switch element at one electrode as a second electrode, and said first switch element is connected with said output electrode of said drive section at another electrode as a first electrode.

3. The display panel driving circuit according to claim 1, wherein said first selector selects said selection gate line, wherein said switch control section selects said selection data line by switching on a selected one, as a selection main switch section, of said plurality of main switch sections, and wherein said drive section outputs said drive signal through said selection main switch and said selection data line to a selected liquid crystal cell selected by said selection gate line and said selection data line from said plurality of liquid crystal cells.

4. The display panel driving circuit according to claim 1, wherein said each of said plurality of main switch sections is configured to further include a capacitive element connected with at least one of a plurality of wirings which connects adjacent ones of said plurality of switch elements.

5. The display panel driving circuit according to claim 4, wherein said first selector selects said selection gate line, wherein said switch control section selects said selection data line by switching on a selected data line, as a selection main switch section, of said plurality of main switch sections, wherein said drive section outputs said drive signal through said selection main switch and said selection data line to a selected liquid crystal cell selected by said selection gate line and said selection data line from said plurality of liquid crystal cells, and wherein said switch control section switches off a predetermined one of said plurality of switch elements of said selection main switch section, said predetermined one is placed in a side of said drive section from a position where said capacitive element is connected, and then said switch control section switches off others of said plurality of switch elements of said selection main switch section.

6. The display panel driving circuit according to claim 1, wherein said second selector is configured to further include a plurality of sub-switch sections as a switch, wherein a plurality of wirings connects adjacent ones of a plurality of switch elements of each of said plurality of main switch sections, and wherein each of said plurality of sub-switch sections is connected with at least one of said plurality of wiring of a corresponding one of said plurality of main switch sections at one electrode, and a power source at another electrode.

7. The display panel driving circuit according to claim 6, wherein said switch control section switches on ones of said plurality of sub-switch sections in order to apply a predetermined voltage by said power source to an associated one of said plurality of wirings, and wherein said ones of said plurality of sub-switch sections are associated with ones, which is switched off, of said plurality of main switch sections.

8. The display panel driving circuit according to claim 7, wherein said first selector selects said selection gate line, wherein said switch control section selects said selection data line by switching on a selected one, as a selection main switch section, of said plurality of main switch sections, and switches off one, which is associated with said selection main switch section, of said plurality of sub-switch section, and wherein said drive section outputs said drive signal through said selection main switch and said selection data line to a selected liquid crystal cell selected by said selection gate line and said selection data line from said plurality of liquid crystal cells.

9. The display panel driving circuit according to claim 6, wherein a voltage which said power source applies to said plurality of wirings is approximately a half of a maximum voltage of said drive signals.

10. The display panel driving circuit according to claim 6, wherein a voltage which said power source applies to said plurality of wiring is approximately a voltage in which a ratio of a change of transmittance to a change of an applied voltage to each of said plurality of liquid crystal cells is maximum.

11. The display panel driving circuit according to claim 1, wherein each of said plurality of switch elements includes a thin film transistor, said thin film transistor is formed on a substrate where said plurality of liquid crystal cells are formed.

12. A capacitive load driving circuit, comprising:

a plurality of capacitive loads;

a plurality of main switch sections;

a drive section configured to output drive signals which drive said plurality of capacitive loads, based on inputted signals which control said plurality of capacitive loads; and a switch control section configured to control switching on and off of said plurality of main switch sections, wherein each of said plurality of main switch sections includes a plurality of switch elements in series, wherein said each of said plurality of main switch sections is provided with an associated one of said plurality of capacitive loads, wherein said each of said plurality of main switch sections is connected with said associated one of plurality of capacitive loads at one end electrode, and wherein said each of said plurality of main switch sections is connected with an output electrode of said drive section and others of said plurality of main switch sections at another end electrode.

13. The capacitive load driving circuit according to claim 12, wherein said each of said plurality of main switch sections is configured to include a first switch element and a second switch element connected with each other in series as said plurality of switch elements, wherein said second switch element is connected with an associated one of said plurality of capacitive loads at one electrode as a fourth electrode, wherein said second switch element is connected with said first switch at another electrode as a third electrode, wherein said first switch element is connected with said second switch element at one electrode as a second electrode, and said first switch element is connected with said output electrode of said drive section at another electrode as a first electrode.

14. The capacitive load driving circuit according to claim 13, wherein said each of said plurality of main switch sections is configured to further include a capacitive element connected with at least one of said second electrode and said third electrode.

15. The capacitive load driving circuit according to claim 13, wherein said each of said plurality of main switch sections is configured to further include a sub-switch section as a switch, connected with at least one of said second electrode and said third electrode at one electrode, and a power source at another electrode.

16. The capacitive load driving circuit according to claim 15, wherein a voltage which said power source applies to said each of said plurality of main switch sections is approximately a half of a maximum voltage of said drive signals.

17. A display panel driving method, comprising:

providing a display panel driving circuit which includes:

a plurality of gate lines configured to extend to a first direction;

a plurality of data lines configured to extend in a second direction different from said first direction; and a plurality of liquid crystal cells configured to be placed in positions corresponding to crossover points between said plurality of gate lines and said plurality of data lines;

selecting one of said plurality of data lines;

applying a predetermined voltage to a selected one of said plurality of data lines;

connecting said selected one of said plurality of data lines with an associated one of said plurality of liquid crystal cells; and outputting a picture signal to said one of said selected one of said plurality of data lines during stopping said applying said predetermined voltage to said selected one of said plurality of data lines.

18. The display panel driving method according to claim 17, wherein said display panel driving circuit further includes a plurality of capacitive elements, each of which is configured to be connected with an associated one of said plurality of data lines, in said providing a display panel driving circuit, and wherein said applying a predetermined voltage to said selected one of said plurality of data lines includes:

applying said predetermined voltage to said selected one of said plurality of data lines and said associated one of plurality of capacitive elements.

19. The display panel driving method according to claim 17, wherein said predetermined voltage is approximately a half of a maximum voltage of said drive signal.

20. The display panel driving method according to claim 17, wherein said predetermined voltage is approximately a voltage in which a ratio of a change of transmittance to a change of an applied voltage to each of said plurality of liquid crystal cells is maximum.

21. A display panel, comprising:

a plurality of data lines;

a terminal which receives an image signal; and a plurality of switch sections each coupled between a corresponding one of said data lines and said terminal, wherein said switch sections each has a plurality of transistors formed on an insulating substrate, said plurality of transistors of said switch section being coupled in series between said corresponding one of said data line and said terminal.

22. The panel as claimed in claim 21, wherein a connection node of said transistors is selectively supplied with a predetermined voltage.

23. The panel as claimed in claim 22, wherein said transistor is comprises a thin film transistor (TFT).

24. The panel as claimed in claim 22, wherein said transistor is comprises an organic transistor.

25. The panel as claimed in claim 21, further comprising an output circuit which outputs said image signal.

* * * * *